United States Patent [19]

Plata

[11] Patent Number: 4,674,555

[45] Date of Patent: Jun. 23, 1987

[54] MOLD

[75] Inventor: Miroslaw Plata, Sion, Switzerland

[73] Assignee: Swiss Aluminum Ltd., Chippis, Switzerland

[21] Appl. No.: 731,469

[22] Filed: May 7, 1985

[30] Foreign Application Priority Data

May 11, 1984 [CH] Switzerland ..... 2319/84

[51] Int. Cl.[4] ..... B22D 11/16

[52] U.S. Cl. ..... 164/150; 164/431; 164/432; 136/225; 374/179

[58] Field of Search ..... 164/4.1, 451, 150, 151, 164/430, 431, 432, 479, 481; 136/230, 225, 234, 233; 374/179

[56] References Cited

U.S. PATENT DOCUMENTS 3,305,405 2/1967 Jamieson ..... 136/233 X
3,338,752 8/1967 Finney ..... 136/233
3,554,816 1/1971 Moen ..... 136/233
3,864,973 2/1975 Petry ..... 164/150 X

FOREIGN PATENT DOCUMENTS 1137432 12/1968 United Kingdom ..... 374/179
248288 12/1969 U.S.S.R. ..... 136/225

*Primary Examiner*—Kuang Y. Lin
*Attorney, Agent, or Firm*—Bachman & LaPointe

[57] ABSTRACT

A mold of a caterpillartype track mold for a continuous caster features at least at one place a pair of wires which form a thermocouple and make first contact outside the mold. The wires are inserted into the mold in such a manner that their other ends are separated from the surface of the mold facing the melt by a metallic layer which joins these wires and is at most 100 μm thick. The process for manufacturing this mold is such that the metallic layer is electro-deposited on to the ends of the wires.

4 Claims, 2 Drawing Figures

MOLD

BACKGROUND OF THE INVENTION

The present invention relates to a mold for casting metals, a process for manufacturing such a mold, and an application employing the mold.

The choice of material for, coating, dimensions and temperature of the mold substantially influence the solidification rate and thus the quality of the cast material. In the case of a given mold and possibly given coating substance, the solidification rate can be controlled before or during casting by regulating the thickness of insulating coating on the mold and by regulating the intensity of mold cooling. This regulation is determined according to the experience of the casting specialist or according to the heat balance of the mold, which has been determined periodically or continuously. Accurate determination of the heat balance, including rapid response to changes, requires, however, true measurement of temperature at places which are often not readily accessable. With conventional molds this cannot be performed satisfactorily.

The object of the present invention is to develop a mold and a process for its manufacture whereby the heat flux through the mold surface facing the melt can be determined rapidly and without interference.

SUMMARY OF THE INVENTION

The foregoing is achieved by way of the present invention wherein, at least at one place in the mold, a pair of wires forming a thermocouple is set into the mold in such a manner that the first contact spot of the two thermocouple wires, which are joined to form a closed loop, is outside the mold on the side facing away from the melt, and the other ends of the two wires are separated from the surface of the mold facing the melt by a metallic layer which joins these two wire ends and is at most 100 μm thick.

The production of such a mold is, according to the invention, such that the metallic layer is electro-deposited on to the ends of the wires. Also embraced by the invention is the production of this metallic layer by plasma spraying, vapor deposition or sputtering.

The layer is, usefully, of silver.

Such mold permit temperature measurements immediately below the surface, from which an accurate heat balance of the mold can be determined, especially if thermocouples are inserted according to the invention at various places in the mold. Due to the small mass of the thermoelements and to the exclusively metallic connections between the mold surface and the places where connection is made to the wires, the response time of the thermocouples is very short, so that up to 5000 individual measurements can be made per second. With this amount of information and high speed at which it is supplied the cooling of the mold can be regulated efficiently. Likewise, for example by carefully controlling the amount of mold coating powder deposited on the mold surface, the thickness of the insulating layer can also be regulated.

Within the scope of the present invention a mold which has proved particularly useful is such that it features at least one through hole which passes perpendicularly through the surface of the mold that faces the melt. A body made substantially of the same material as the mold is fitted, without leaving any gaps, into the said hole. The surface of this body facing the melt provides continuity in the mold surface interrupted by this hole which the body fills. The body itself features along its central axis a bore in which the insulated thermocouple wires reside. The above mentioned layer that joins the ends of the wires forms a part of the surface of the said inserted body.

The heat flow within the mold is only extremely slightly influenced by the inserted body. Mold repairs are facilitated by the ease with which the body can be removed.

The mold according to the invention can be employed with all metal casting processes such as continuous direct chill casting and for shape casting. The mold is, however, particularly advantageous in continuous strip casters, especially for casting aluminum strips using pairs of cooled caterpiller type mold. These strip casters demand rapid measurement because of the high speed of casting. The use of the mold according to the invention is not detrimental to the, with respect to the volume, large surface area of the cast strip.

BRIEF DESCRIPTION OF THE DRAWINGS

Further advantages, features and details of the invention are revealed in the following description of a preferred exemplified embodiment and with the aid of the drawings wherein.

DETAILED DESCRIPTION

Figure 1:
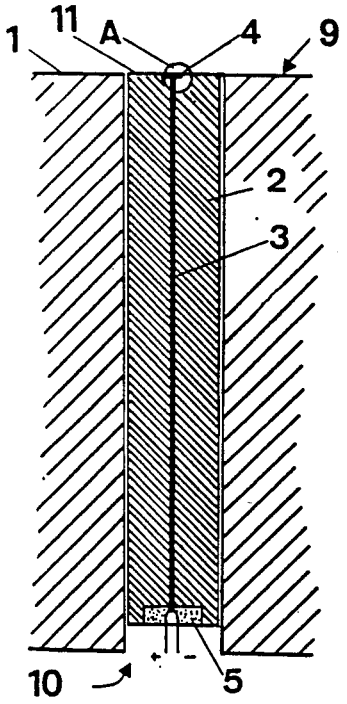
FIG. 1 is a cross-section through a body set into the mold and surrounding a thermocouple.

The copper-based mold 9 in FIG. 1 is a mold block forming part of a continuous casting unit with caterpillar track type molds (CASTER II). The mold 9 features, perpendicular to the face coming into contact with the melt, not shown here, a continuous cylindrical hole 10 into which a close-fitting 10 mm diameter, copper-based body 2 is inserted. The surface 11 of the said body 2 lies on the same plane as surface 1 of the mold 9. The body 2 features along its central axis a bore 3 which is closed at one end by a silver layer 4; layer 4 constitutes part of surface 11. Bore 3 is closed off at the other end by an aluminum plate 5.

Figure 2:
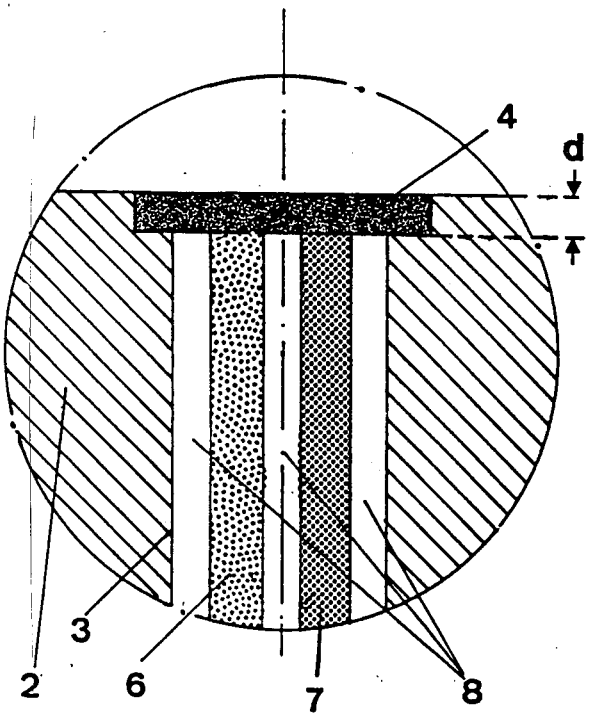
FIG. 2 is an enlarged view of detail A at one end of the body shown in FIG. 1.

Running through bore 3 are two 100 μm thick conductor wires of Chromel 6 and Alumel 7 respectively, see FIG. 2, which are separated from each other and from the copper mantle of the body 2 by 10 μm thick insulating layers 8 of Mica. The conductors 6 and 7 are connected via the 50 μm thick (d) electrodeposited layer 4, and at the other end pass through the aluminua plate 5.

Both tracks or belts of the continuous casting unit feature a plurality of copper blocks of the type represented by mold 9.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for the continuous casting of molten metal comprising at least two opposed revolving tracks having opposed surfaces defining a mold cavity for receiving molten metal, the improvement comprising: at least one bore in at least one of said revolving tracks and a thermocouple in said at least one bore, said thermocouple comprising a pair of wires joined to a metallic layer which forms a portion of the surface of said at least one of said revolving tracks defining said mold cavity.

2. An apparatus according to claim 1 wherein the metallic layer is not more than 100 $\mu$m thick.

3. An apparatus according to claim 1 comprising a body received in said at least one bore wherein said pair of wires and said metallic layer are received in a bore in said body and insulating layers are provided between said body and said pair of wires.

4. An apparatus according to claim 1 wherein the metallic layer is silver.

* * * * *